US008733090B2

(12) United States Patent
Coonrod et al.

(10) Patent No.: US 8,733,090 B2
(45) Date of Patent: May 27, 2014

(54) METHODS AND SYSTEMS FOR SUBSEA ELECTRIC PIEZOPUMPS

(75) Inventors: Don Coonrod, Katy, TX (US); Melvyn F. Whitby, Houston, TX (US); Gerrit M. Kroesen, Friendswood, TX (US); Ronald W. Webb, Houston, TX (US); Mac M. Kennedy, Houston, TX (US); Katherine Harvey, Houston, TX (US); David Gonzalez, Houston, TX (US); Thomas M. Bell, Houston, TX (US); James W. Wilkirson, Friendswood, TX (US)

(73) Assignee: Cameron International Corporation, Houston, TX (US)

( * ) Notice: Subject to any disclaimer, the term of this patent is extended or adjusted under 35 U.S.C. 154(b) by 981 days.

(21) Appl. No.: 12/815,807

(22) Filed: Jun. 15, 2010

(65) Prior Publication Data

US 2011/0302911 A1 Dec. 15, 2011

(51) Int. Cl.
*F04B 43/04* (2006.01)

(52) U.S. Cl.
USPC ..... 60/485; 166/65.1

(58) Field of Classification Search
USPC ..... 60/486; 166/65.1
See application file for complete search history.

(56) References Cited

U.S. PATENT DOCUMENTS

| | | | | |
|---|---|---|---|---|
| 4,777,800 | A | 10/1988 | Hay, II | |
| 4,983,876 | A | 1/1991 | Nakamura et al. | |
| 6,116,866 | A * | 9/2000 | Tomita et al. | 417/413.2 |
| 6,321,845 | B1 * | 11/2001 | Deaton | 166/66.5 |
| 6,637,200 | B2 * | 10/2003 | Barba et al. | 60/486 |
| 6,761,028 | B2 * | 7/2004 | Takeuchi et al. | 60/486 |
| 7,073,329 | B2 * | 7/2006 | Bruhl et al. | 60/486 |
| 7,111,675 | B2 * | 9/2006 | Zisk, Jr. | 166/65.1 |
| 7,267,043 | B2 * | 9/2007 | Wright et al. | 60/473 |
| 8,037,989 | B2 * | 10/2011 | Neelakantan et al. | 192/85.63 |
| 2009/0148317 | A1 | 6/2009 | Pietron et al. | |
| 2010/0012313 | A1 * | 1/2010 | Longfield et al. | 166/66.6 |

FOREIGN PATENT DOCUMENTS

| | | | |
|---|---|---|---|
| JP | 2298679 | A | 12/1990 |
| JP | 2008151144 | A | 7/2008 |
| WO | 2009123476 | A1 | 10/2009 |

OTHER PUBLICATIONS

PCT/US2011/035555 International Search Report and Written Opinion, Oct. 25, 2011 (9 p.).
Singapore Written Opinion dated Jun. 14, 2013 for Application No. 201208146-9 filed on May 6, 2011.

* cited by examiner

*Primary Examiner* — Thomas E Lazo
(74) *Attorney, Agent, or Firm* — Chamberlain Hrdlicka

(57) ABSTRACT

In at least some embodiments, an apparatus includes a hydraulic directional control manifold and a plurality of electric piezopumps. The apparatus also includes an electric piezopump controller that operates the plurality of electric piezopumps in varying combinations to provide generation and directional control of hydraulic power to linear hydraulic actuators using localized closed-loop hydraulic fluid.

19 Claims, 10 Drawing Sheets

METHODS AND SYSTEMS FOR SUBSEA ELECTRIC PIEZOPUMPS

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND

Deepwater accumulators provide a supply of pressurized working fluid for the control and operation of subsea equipment, such as through hydraulic actuators and motors. Typical subsea equipment may include, but is not limited to, blowout preventers (BOPS) that shut off the well bore to secure an oil or gas well from accidental discharges to the environment, gate valves for the control of flow of oil or gas to the surface or to other subsea locations, or hydraulically actuated connectors and similar devices.

Accumulators are typically divided pressure vessels with a gas section and a hydraulic fluid section that operate on a common principle. The principle is to precharge the gas section with an inert, dry, ideal gas (usually nitrogen or helium), pressurized to a pressure at or slightly below the anticipated minimum pressure required to operate the subsea equipment. Hydraulic fluid will then be added (or "charged") to the accumulator in the separate hydraulic fluid section, increasing the pressure of the pressurized gas and the hydraulic fluid to the maximum operating pressure of the control system. The precharge pressure determines the pressure of the very last trickle of fluid from the fluid side of the accumulator, and the charge pressure determines the pressure of the very first trickle of fluid from the fluid side of the accumulator. The discharged fluid between the first and last trickle will be at some pressure between the charge and precharge pressure, depending on the speed and volume of the discharge and the ambient temperature during the discharge event. The hydraulic fluid introduced into the accumulator is therefore stored at the maximum control system operating pressure until the accumulator is discharged for the purpose of doing hydraulic work.

Accumulators generally come in three styles—the bladder type having a balloon type bladder to separate the gas from the fluid, the piston type having a piston sliding up and down a seal bore to separate the fluid from the gas, and the float type with a float providing a partial separation of the fluid from the gas and for closing a valve when the float approaches the bottom to prevent the escape of the precharging gas. A fourth type of accumulator is pressure compensated for water depth and adds the precharge pressure plus the ambient seawater pressure to the working fluid.

The precharge gas can be said to act as a spring that is compressed when the gas section is at its lowest volume/greatest pressure and released when the gas section is at its greatest volume/lowest pressure. Accumulators are typically precharged on the surface in the absence of hydrostatic pressure and subsequently charged with hydraulic fluid on the seabed under full hydrostatic pressure. The surface precharge pressure is limited by the pressure containment and structural design limits of the accumulator vessel under surface ambient conditions. Yet, as accumulators are used in deeper water, the efficiency of conventional accumulators decreases as application of hydrostatic pressure causes the gas to compress, leaving a progressively smaller volume of gas to charge the hydraulic fluid. The gas section must consequently be designed such that the gas still provides enough power to operate the subsea equipment under hydrostatic pressure even as the hydraulic fluid approaches discharge and the gas section is at its greatest volume/lowest pressure.

The use of accumulators at extreme water depths requires large aggregate accumulator volumes that increase the size and weight of the overall subsea equipment assemblies. Yet, offshore rigs continue moving further and further offshore to drill in deeper and deeper water. Because of the ever increasing envelop of operation, traditional accumulators are becoming unmanageable with regards to quantity and location inside existing stack frames. In some instances, it has even been suggested that in order to accommodate the increasing demands of the conventional accumulator system, a separate subsea skid may have to be run in conjunction with the subsea BOP stack in order to provide the required volume necessary at the limits of the water depth capability of the subsea BOP stack. With rig operators increasingly putting a premium on minimizing size and weight of the drilling equipment to reduce drilling costs, the size and weight of all drilling equipment must be optimized.

The bulk transmission of hydraulic power to accumulators are affected by the ambient pressure at the sea floor and requires their designs to account for: 1) hydrostatic effects; 2) consequential design pressure ratings for subsea hydraulic accumulator pre-charge; and 3) volume requirements to meet performance requirements for the external hydraulic actuator. Also, transmission of hydraulic power through pipes is subject to line pressure losses due to line geometry, length, and fluid conditions. Further, different external hydraulic actuators require differing regulated pressure, requiring the use of a plurality of regulators for each type of hydraulic actuator.

Prior approaches to addressing operation of subsea linear actuators have involved replacement of the linear hydraulic actuator with a rotary electric motor, transmission, clutch, and lock. However, electromechanical losses associated with the electric rotary motor and mechanical losses associated with the transmission, clutch, and lock have led to power inefficiencies and significant complexity increases that reduce reliability, availability, and maintainability of all electric solutions over all hydraulic solutions.

SUMMARY OF THE PREFERRED EMBODIMENTS

In at least some embodiments, an apparatus includes a hydraulic directional control manifold and a plurality of electric piezopumps. The apparatus also includes an electric piezopump controller that operates the plurality of electric piezopumps in varying combinations to provide generation and directional control of hydraulic power to linear hydraulic actuators using localized closed-loop hydraulic fluid.

In at least some embodiments, a method includes receiving a hydraulic directional control signal and selectively operating a plurality of electric piezopumps based on the hydraulic directional control signal. The method also includes controlling generation and directional control of hydraulic power to at least one linear hydraulic actuator in response to operating the plurality of electric piezopumps using localized closed-loop hydraulic fluid.

In at least some embodiments, a piezoelectric pump assembly for use in a subsea environment includes a piezoelectric actuator and a piston reciprocated by the piezoelectric actuator. The piezoelectric pump assembly also includes a pump chamber, wherein hydraulic fluid is drawn into the pump chamber through a suction reed valve and is expelled from the pump chamber through a discharge reed valve.

BRIEF DESCRIPTION OF THE DRAWINGS

For a more detailed description of the embodiments, reference will now be made to the following accompanying drawings.

DETAILED DESCRIPTION OF THE PREFERRED EMBODIMENTS

Figure 1:
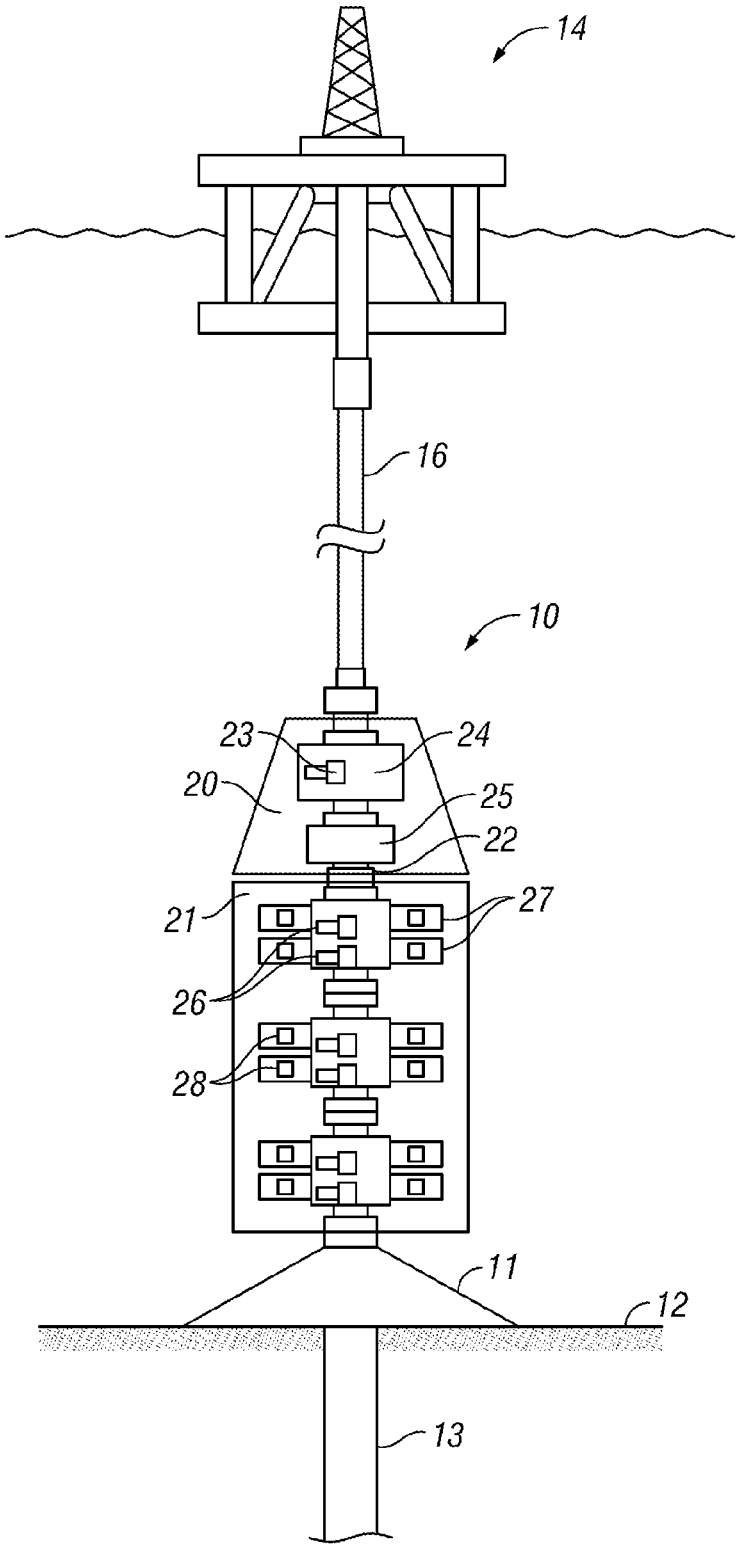
FIG. 1 shows a blowout preventer (BOP) stack assembly in accordance with an embodiment of the disclosure.

In the drawings and description that follows, like parts are marked throughout the specification and drawings with the same reference numerals, respectively. The drawing figures are not necessarily to scale. Certain features of the invention may be shown exaggerated in scale or in somewhat schematic form and some details of conventional elements may not be shown in the interest of clarity and conciseness. The present invention is susceptible to embodiments of different forms. Specific embodiments are described in detail and are shown in the drawings, with the understanding that the present disclosure is to be considered an exemplification of the principles of the invention, and is not intended to limit the invention to that illustrated and described herein. It is to be fully recognized that the different teachings of the embodiments discussed below may be employed separately or in any suitable combination to produce desired results. Any use of any form of the terms "connect", "engage," "couple," "attach," or any other term describing an interaction between elements is not meant to limit the interaction to direct interaction between the elements and may also include indirect interaction between the elements described. The various characteristics mentioned above, as well as other features and characteristics described in more detail below, will be readily apparent to those skilled in the art upon reading the following detailed description of the embodiments, and by referring to the accompanying drawings.

Embodiments disclosed herein utilize bidirectional cartridge piezopump assemblies (described in FIGS. 3-9) to enable operation of a wide range of subsea hydraulic linear actuators with varying volumetric and pressure requirements. The disclosed bidirectional cartridge piezopump assemblies minimize the number of unique components necessary to operate a variety of subsea hydraulic linear actuators. Further, the disclosed bidirectional cartridge piezopump assemblies are compatible with subsea electrical operations of conventional hydraulic linearly actuated equipment. In at least some embodiments, the disclosed bidirectional cartridge piezopump assemblies enable closed-loop operation of subsea hydraulically linearly actuated equipment, eliminating discharge of hydraulic control fluid to the environment.

FIG. 1 shows a blowout preventer (BOP) stack assembly 10 in accordance with an embodiment of the disclosure. In accordance with embodiments, various components of the BOP stack assembly 10 are operated using the disclosed bidirectional cartridge piezopump assemblies (described in FIGS. 3-9). In FIG. 1, the BOP stack assembly 10 is assembled onto a wellhead assembly 11 on the sea floor. The BOP stack assembly 10 is connected in line between the wellhead assembly 11 and a floating rig 14 through a subsea riser 16. The BOP stack assembly 10 provides emergency pressure control of drilling/formation fluid in the wellbore 13 should a sudden pressure surge escape the formation into the wellbore 13. The BOP stack assembly 10 thus prevents damage to the floating rig 14 and the subsea riser 16 from fluid pressure exiting the wellhead assembly 11.

In FIG. 1, the BOP stack assembly 10 includes a BOP lower marine riser package (LMRP) 20 that connects the riser 16 to a BOP stack package 21. In accordance with embodiments, the LMRP 20 and the BOP stack package 21 comprise hydraulic linear actuators with varying volumetric and pressure requirements. For example, the LMRP 20 may comprise comprise a BOP annular 24, an annular bleed valve 23, an LMRP connector 25 and an LMRP collet connector 22 with respective hydraulic linear actuators that may be operated by the disclosed bidirectional cartridge piezopump assemblies. Meanwhile, the BOP stack package 21 comprises a plurality of BOP Ram units 27 and failsafe gate valves 26. The BOP stack package 21 further comprises a BOP Ram lock 28 for each BOP Ram unit 27. The BOP Ram units 27, the BOP Ram locks 28, and the failsafe gate valves 26 have respective hydraulic linear actuators that may be operated by the disclosed bidirectional cartridge piezopump assemblies.

Figure 2:
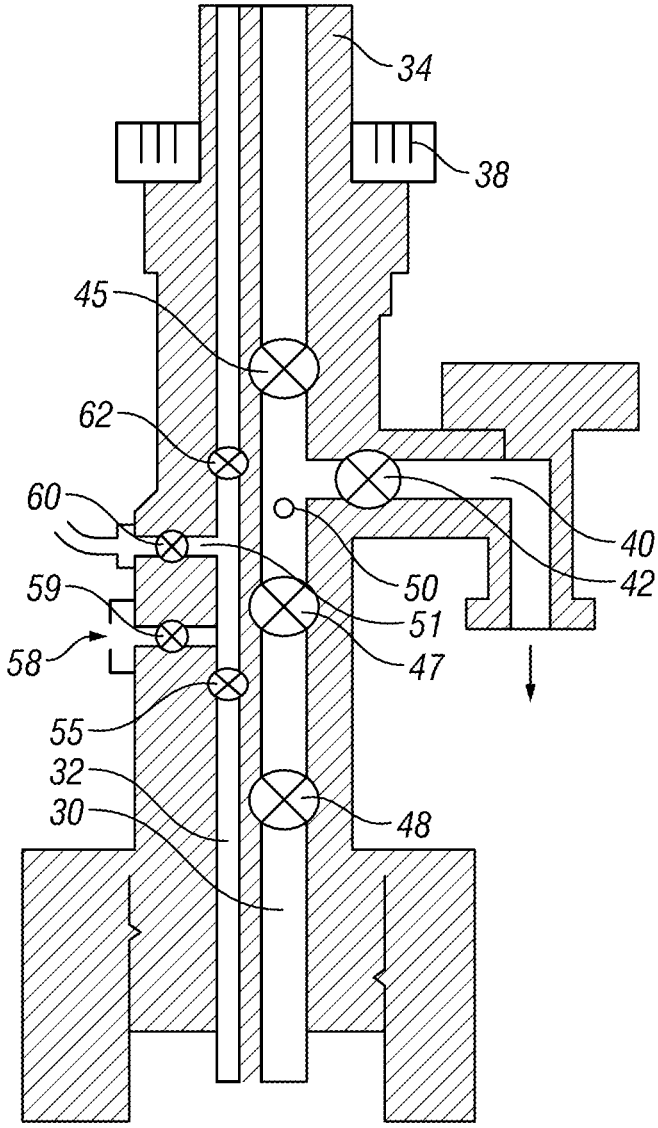
FIG. 2 shows a subsea tree cross-section in accordance with an embodiment of the disclosure.

As another example, the disclosed bidirectional cartridge piezopump assemblies also may operate various components of a subsea tree. As shown in FIG. 2, a subsea tree comprises a production bore 30 leading from production tubing (not shown) and carrying production fluids from a perforated region of the production casing in a reservoir (not shown). An annulus bore 32 leads to the annulus between the casing and the production tubing and a subsea tree cap 34 which seals off the production and annulus bores 30, 32, and provides a number of hydraulic control channels 38 by which a remote platform or intervention vessel can communicate with and operate the valves in the subsea tree. The cap 34 is removable from the subsea tree in order to expose the production and annulus bores in the event that intervention is required and tools need to be inserted into the production or annulus bores 30, 32.

The flow of fluids through the production and annulus bores is governed by various valves shown in the subsea tree of FIG. 2. The production bore 30 has a branch 40 which is closed by a production wing valve (PWV) 42. A production swab valve (PSV) 45 closes the production bore 30 above the branch 40 and PWV 42. Two lower valves UPMV 47 and LPMV 48 (which is optional) close the production bore 30 below the branch 40 and PWV 42. Between UPMV 47 and PSV 45, a crossover port (XOV) 50 is provided in the production bore 30 which connects to the crossover port (XOV) 51 in annulus bore 32.

The annulus bore is closed by an annulus master valve (AMV) 55 below an annulus outlet 58 controlled by an annulus wing valve (AWV) 59, itself below crossover port 51. The crossover port 51 is closed by crossover valve 60. An annulus swab valve 62 located above the crossover port 51 closes the upper end of the annulus bore 32. Some or all of the valves in the subsea tree of FIG. 2 have respective hydraulic linear actuators that may be operated by the disclosed bidirectional cartridge piezopump assemblies.

The disclosed bidirectional cartridge piezopump assemblies may be customized for a particular BOP stack assembly or subsea tree. For example, in some embodiments, components of a bidirectional cartridge piezopump assembly are directly mountable to the BOP stack assembly components of FIG. 1 or the subsea tree components of FIG. 2. In this manner, external piping and tubing interconnections are avoided. As a specific example, a directional control manifold for each bidirectional cartridge piezopump assembly may be mounted directly onto an external hydraulic linear actuator without need of external piping and tubing for open and close functions. Further, the directional control manifold is able to swivel without disconnection of external cabling, tubing, or piping. In this manner, maintenance access is facilitated for the directional control manifold as well as the external hydraulic linear actuator.

The operation of the hydraulic linear actuators (e.g., those referred to in FIGS. 1 and 2) based on the disclosed bidirectional cartridge piezopump assemblies may be improved using pressure-compensation techniques to allow operation at any external ambient pressure. Further, elastomeric barriers of each bidirectional cartridge piezopump assembly may segregate dielectric fluid, hydraulic control fluid, and seawater to facilitate actuator functionality. Further, the connections of the elastomeric barriers are arranged to operate with a high frequency/low-displacement motion of the piezopump piston.

Figure 3:
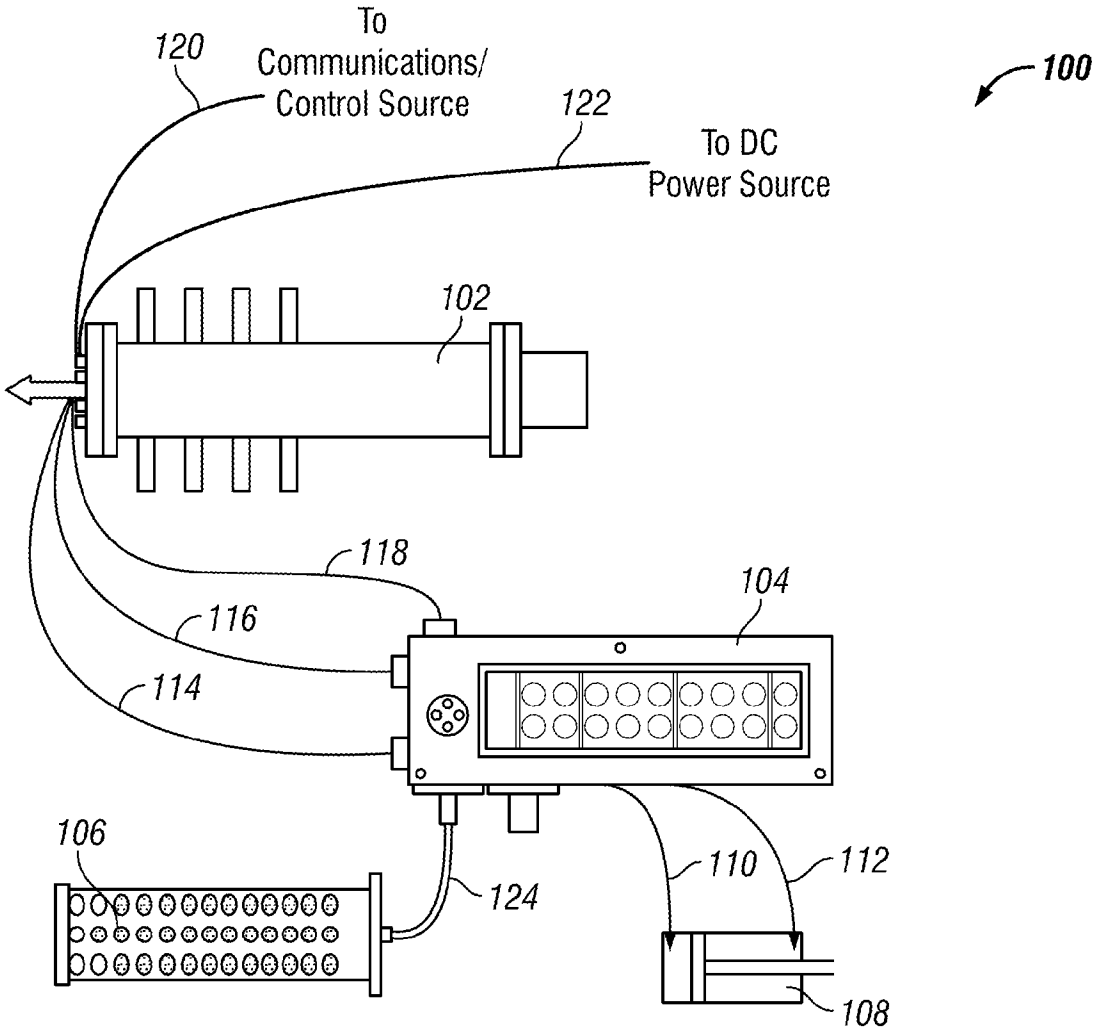
FIG. 3 shows a bidirectional cartridge piezopump assembly for use with the subsea riser assembly of FIG. 1 or the subsea tree of FIG. 2 in accordance with an embodiment of the disclosure.

FIG. 3 shows a bidirectional cartridge piezopump assembly 100 in accordance with an embodiment of the disclosure. As mentioned previously, the components of the bidirectional cartridge piezopump assembly 100 may be mounted to a BOP stack assembly or subsea tree (e.g., near the linear hydraulic actuators to be operated). As shown, the system 100 comprises a piezopump actuator controller 102, a piezopump directional control manifold 104, a hydraulic differential reservoir 106, and an external hydraulic line actuator 108. The piezopump actuator controller 102 is configured to receive direct current (DC) power from an external DC power supply cable 122. Further, the piezopump actuator controller 102 is configured to receive communications from an external communications and instrument power cable 120. In some embodiments, the cables 120 and 122 correspond to pressure balanced oil filled (PBOF) cables. The source of communications received by the piezopump actuator controller 102 via the cable 120 may be, for example, a communications/control center on a surface facility of a vessel or rig. Similarly, the source of DC power received by the piezopump actuator controller 102 via the cable 122 may be, for example, a DC power generator or converter on a surface facility of a vessel or rig.

With DC power and communications (e.g., commands, instructions) received from cables 120 and 122, the piezopump actuator controller 102 is able to direct the operations of the piezopump directional control manifold 104. More specifically, the piezopump actuator controller 102 is able to provide pump power to the piezopump directional control manifold 104 via a piezopump power cable 118. Further, the piezopump actuator controller 102 is able to provide direction control signals to the piezopump directional control manifold 104 via a directional control cable 116. Further, the piezopump actuator controller 102 is able to use open/close pressure transducer signals from the piezopump directional control manifold 104 via an open/close pressure transducer cable 114.

In response to direction control signals and open/close pressure transducer control signals received from the piezopump actuator controller 102, the piezopump directional control manifold 104 controls the operating force of the external hydraulic linear actuator 108. More specifically, in response to receiving an open pressure transducer signal via cable 114, the piezopump directional control manifold 104 may control the open port connection 112 and close port connection 110 pressure and flowrate at the external hydraulic linear actuator 108. In at least some embodiments, the piezopump directional control manifold 104 is able to control the direction of linear movement for the external hydraulic linear actuator 108 based on a direction control signal received via cable 116, which allows piezopumps to pump control fluid from the close port 110 to the open port 112 when opening the external hydraulic linear actuator 108, or conversely pumping from the open port 112 to the close port 110 when closing the external hydraulic actuator 108. Open and close port pressure measurements are used to regulate the opening and closing pressures at 110 and 112. The cables 114, 116 and 118 may be PBOF cables.

In at least some embodiments, the hydraulic fluid used to operate the external hydraulic linear actuator 108 is provided by a hydraulic differential reservoir 106, which provides localized closed-loop hydraulic fluid for the bidirectional cartridge piezopump assembly 100. As shown, the hydraulic differential reservoir 106 connects to the piezopump direction control manifold 104 via hose 124. Although not required, the piezopump directional control manifold 104 may be subplate mounted to the external hydraulic linear actuator 108.

In accordance with various embodiments, the bidirectional cartridge piezopump assembly 100 may be modified. For example, a single hydraulic differential reservoir 106 may provide fluid to multiple piezopump directional control manifolds 104. Likewise, a single piezopump actuator controller 102 may provide control signals to multiple piezopump directional control manifolds 104. Additionally, different piezopump directional control manifolds 104 may vary in size to support varying volumetric and pressure requirements of different linear hydraulic actuators.

As an example, for the LMRP 20 of FIG. 1, a modified bidirectional cartridge piezopump assembly 100 may be implemented. More specifically, the BOP annular 24 and the LMRP connector 25 may each have assigned thereto a full-size piezopump directional control manifold 104. Meanwhile, the annular bleed valve 23 and the LMRP collet connector 22 may each have assigned thereto a half-size or quarter-size piezopump directional control manifold. A single piezopump actuator controller 102 and a single hydraulic differential reservoir 106 may be employed for the various piezopump directional control manifolds assigned to LMRP 20.

As another example, for the BOP stack assembly 21 of FIG. 1, a modified bidirectional cartridge piezopump assembly 100 may be implemented. More specifically, each BOP Ram unit 27 (there are 12 shown in FIG. 1) may have a full-size piezopump directional control manifold 104 assigned thereto. Additionally, each failsafe gate valve 26 may have a half-size or quarter-size piezopump directional control manifold assigned thereto. Additionally, each BOP Ram lock 28 may have a half-size or quarter-size piezopump directional control manifold assigned thereto. Additionally, the wellhead assembly 11 may have a full-size piezopump directional control manifold 104 assigned thereto. Three or four piezopump actuator controllers 102 may be implemented to control the various piezopump directional control manifolds of the BOP stack assembly 21. Likewise, three or four hydraulic differential reservoirs 106 may provide the control fluid for the piezopump directional control manifolds of the BOP stack assembly 21.

As another example, for the subsea tree of FIG. 1, a modified bidirectional cartridge piezopump assembly 100 may be implemented. More specifically, each of the valves described for FIG. 2 (e.g., PWV 42, PSV 45, UPMV 47, LPMW 48, AMV 55, AWV 59, crossover valve 60, and annulus swab valve 62) may have a half-size or quarter-size piezopump directional control manifold assigned thereto. One or two piezopump actuator controllers 102 may be implemented to control the various piezopump directional control manifolds of the subsea tree. Likewise, one or two hydraulic differential reservoirs 106 may provide the control fluid for the piezopump directional control manifolds of the subsea tree.

Figure 4A:
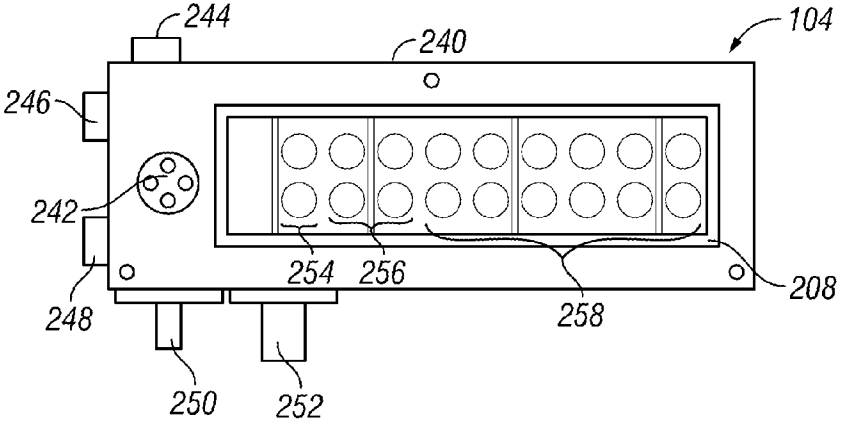
FIGS. 4A-4C shows a knuckle joint arrangement for connection of a piezopump directional control manifold to an external hydraulic linear actuator in accordance with an embodiment of the disclosure.
Figure 4B:
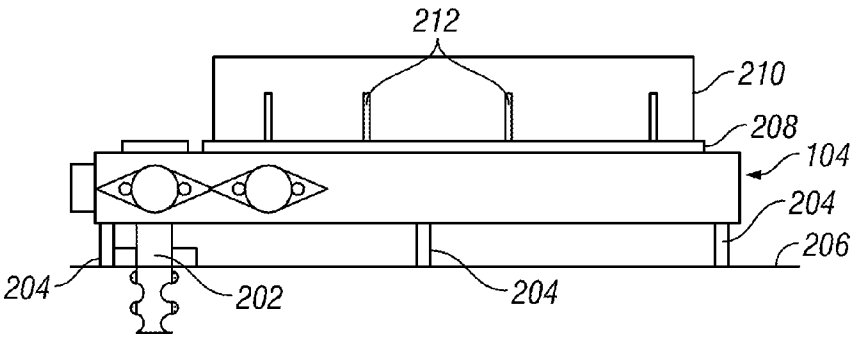
Figure 4C:
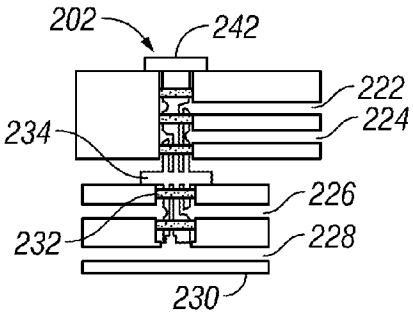

FIG. 4A-4C shows a knuckle joint arrangement for connection of the piezopump directional control manifold 104 to the external hydraulic linear actuator 108 in accordance with an embodiment of the disclosure. More specifically, FIG. 4A shows a top view of the piezopump directional control manifold 104, FIG. 4B shows a side view of piezopump directional control manifold 104, and FIG. 4C shows a knuckle joint cross-section. As shown in FIG. 4A, the piezopump directional control manifold 104 comprises a manifold body 240 with a knuckle joint locking plate 242 extending therethrough. The piezopump directional control manifold 104 also comprises various connectors. More specifically, the piezopump directional control manifold 104 comprises a piezopump power connector 244 to interface with the piezopump power cable 118, an open/close pressure transducer connector 246 to interface with open/close pressure transducer cable 114, a directional control connector 248 to interface with directional control cable 116, and a hydraulic differential reservoir tubing connector 250 to interface with hose 124. The piezopump directional control manifold 104 of FIG. 4A also comprises a filter 252 for the closed loop hydraulic fluid.

The piezopump directional control manifold 104 of FIG. 4A also comprises one pair of open/close pressure transducer pockets 254, two pairs of directional control solenoid value pockets 256, and six pairs of piezopump manifold pockets 258. The number of pockets 254, 256, 258 may vary for different embodiments. Although not explicitly shown, the piezopump directional control manifold 104 also comprises a protective cover for elastomer dielectric barrier 210 (shown in FIG. 4B). In at least some embodiments, the protective cover is made from a perforated durable polymer allowing for some expansion of the elastomeric dielectric barrier 210 due to thermal expansion of the dielectric fluid during operation. The elastomer dielectric barrier 210 is retained by elastomer dielectric barrier retaining ring 208.

As seen in FIG. 4B, the piezopump directional control manifold 104 comprises manifold body standoff rods 204 that contact external hydraulic linear actuator mounting face 206 and cable looms 212 that extend outwardly for organizing power/control lines for the piezopump directional control manifold 104.

As shown in FIG. 4B, the knuckle joint 202 extends through the piezopump directional control manifold 104 and may extend into an external hydraulic linear actuator mounting face 206. In this arrangement, the piezopump directional control manifold 104 is able to rotate freely when the manifold body standoff rods (bolts) 204 are withdrawn. In this manner, the external hydraulic linear actuator 108 can be serviced without removal of the piezopump directional control manifold 104. In such embodiments, the piezopump directional control manifold 104 is efficiently oriented for subsea operation, while affording accessibility during surface maintenance of the piezopump directional control manifold 104 and/or the external hydraulic linear actuator 108.

FIG. 4C shows a cross-section of the knuckle joint 202. As shown in FIG. 4C, the knuckle joint 202 comprises the knuckle joint locking plate 242 and a coax hydraulic knuckle 234. When the knuckle joint 202 is inserted into position, the knuckle joint locking plate 242 rests against a top surface of the piezopump directional control manifold 104. Meanwhile, the coax hydraulic knuckle 234 is positioned between the piezopump directional control manifold 104 and the external hydraulic linear actuator 108. The portion of the knuckle joint 202 that extends through the piezopump directional control manifold 104 interfaces with an actuator open manifold 222 and an actuator close manifold 224 of the piezopump directional control manifold 104. The portion of the knuckle joint 202 that extends into the external hydraulic linear actuator mounting face 206 interfaces with an open port 226 and a close port 228 of the external hydraulic linear actuator 108. As shown in FIG. 4C, the knuckle joint 202 extends though crossport O-rings seats 232 positioned on each side of the actuator open manifold 222, the actuator close manifold 224, the open port 226 and the close port 228.

There are various components that are not shown in FIGS. 4A-4C for convenience. For example, internal cabling, piezopump cartridges, directional control valve cartridges, and open/close pressure transducer cartridges may be installed in the piezopump directional control manifold 104. Further, interconnecting cables are routed from connectors 244, 246, 248 through the manifold body and into the pocket areas 254, 256, 258. In accordance with at least some embodiments, dielectric fluid is present between the connectors 254, 256, 258 and the interior of the elastomeric dielectric barrier 210 to provide electrical isolation integrity. The dielectric fluid also enables heat transfer between installed piezopump cartridges and seawater.

Figure 5:
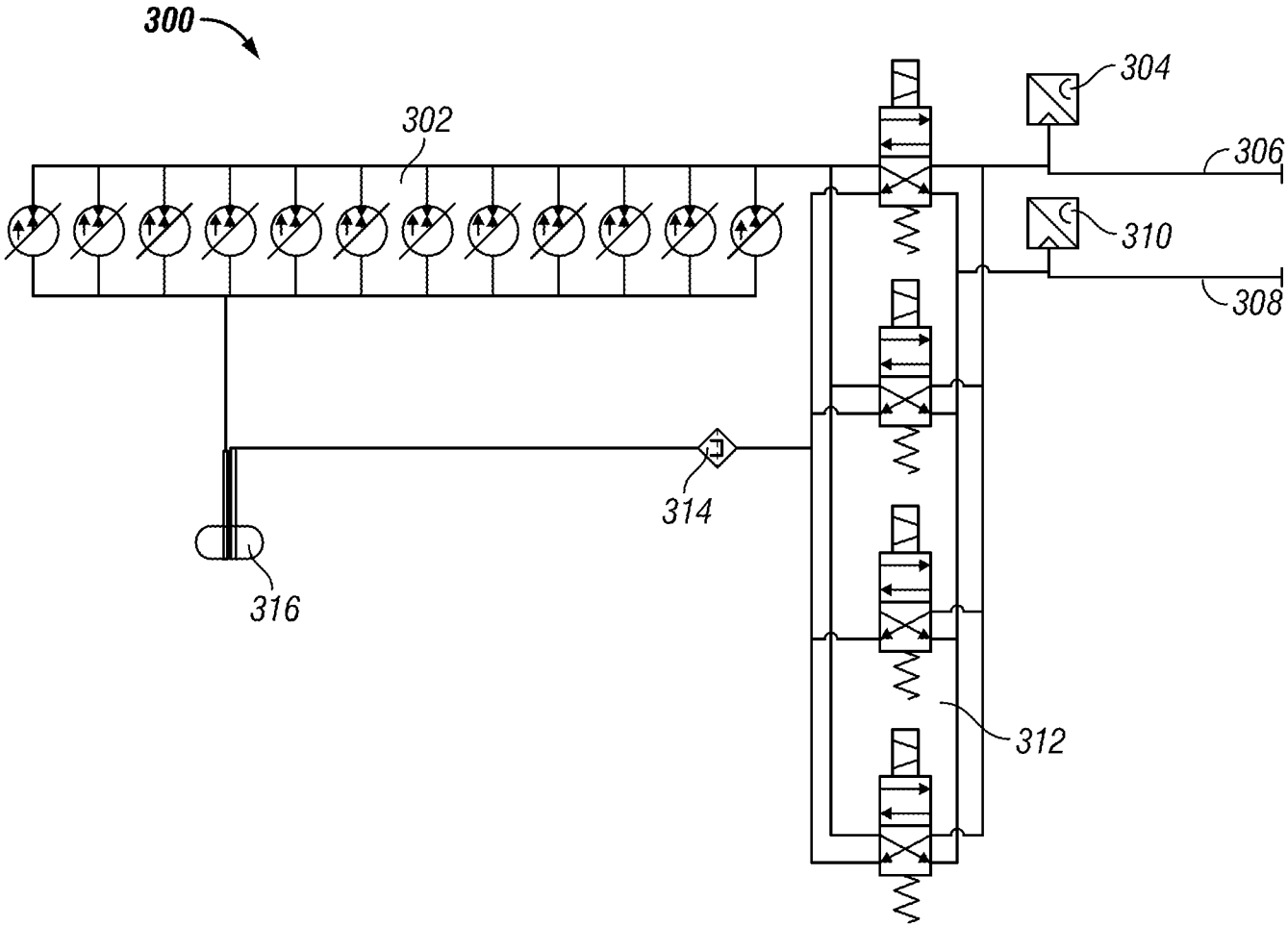
FIG. 5 shows a piping and instrumentation diagram (P&ID) for a piezopump directional control manifold in accordance with an embodiment of the disclosure.

FIG. 5 shows a piping and instrumentation diagram (P&ID) 300 for the piezopump directional control manifold 104 in accordance with an embodiment of the disclosure. The diagram 300 shows various components of the piezopump directional control manifold 104 including an external open port 306 and an external close port 308. The ports 306 and 308 correspond respectively to open pressure transducer 304 and close pressure transducer 310. The operation of the piezopump directional control manifold 104 is managed by a directional control valve bank 312 and a piezopump bank 302. The piezopump bank 302 may vary in size for different embodiments. The hydraulic fluid for operations of the piezopump directional control manifold 104 is provided by hydraulic differential reservoir 316. As shown in diagram 300, a suction filter 314 may be implemented.

During operation, return fluid from the external hydraulic linear actuator 108 is passed through the filter 314 (e.g., a low pressure filter) into the hydraulic differential reservoir 316. The arrangement of diagram 300 allows for continuous filtering of the hydraulic control fluid as the external hydraulic linear actuator 108 is operated. The arrangement of diagram 300 also ensures that the suction pressure to the piezopumps of the piezopump bank 302 is not elevated with respect to the ambient hydrostatic pressure.

Figure 6:
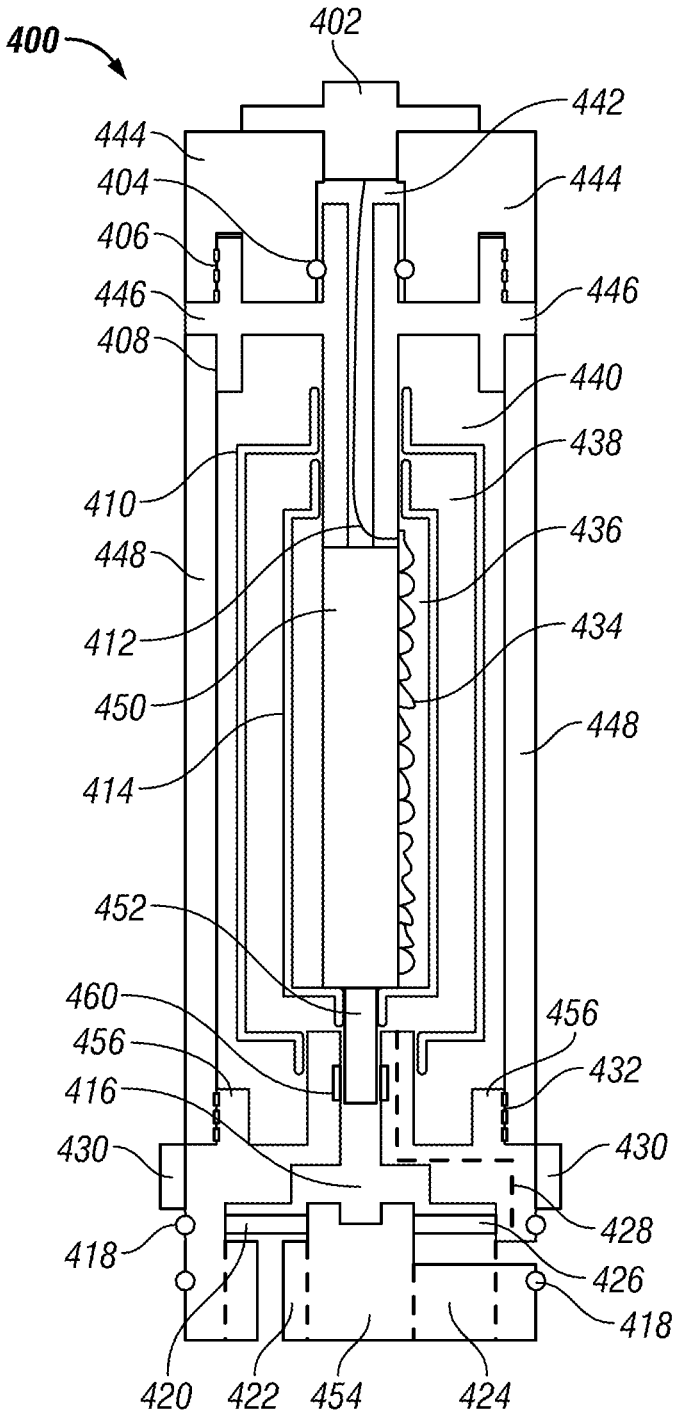
FIG. 6 shows a piezopump cartridge in accordance with an embodiment of the disclosure.

FIG. 6 shows a piezopump cartridge 400 in accordance with an embodiment of the disclosure. In operation, the piezopump cartridge 400 operates using a piezoelectric actuator 450 to reciprocate a low mass piston 452 allowing hydraulic control fluid to be drawn into a pump chamber 416 through a suction reed valve 426 and expelled through a discharge reed valve 420. The suction reed valve 426 is held in place by retainer plug 424. Similarly, the discharge reed value 420 is held in place by retainer plug 422. In at least some embodiments, a labyrinth seal 460 is used with the piston 452 due to the high frequency of reciprocation.

In at least some embodiments, the piezoelectric actuator 450 comprises a stack of piezoelectric wafers connected in parallel to cause the piezoelectric actuator 450 to lengthen and retract. On retraction, the piezoelectric actuator 450 generates electrical power which may be transmitted by the piezopump actuator controller to an external DC power supply. The piezoelectric actuator 450 is surrounded by dielectric fluid 436 to provide electrical isolation between the piezoelectric wafers. Because the labyrinth seal of the piston is not a positive seal, hydraulic control fluid can migrate between the pump chamber 416 and the piezoactuator assembly. In at least some embodiments, a double barrier is used to prevent cross contamination between dielectric fluid 436, hydraulic control fluid 438, and seawater 440. The first barrier 410 corresponds to a seawater/control fluid elastomer tube barrier. The second barrier 414 corresponds to a control fluid/dielectric fluid elastomer tube barrier. The first and second barriers 410 and 414 are used to maintain fluid segregation, allow ambient pressure equalization, and allow for fluid expansion as temperature increases. A perforated tube 432 is used to provide pressure equalization, as well as creating a load path for the piezoelectric actuator 450 to act against. A small cross-section port 428 provides fluid communication between the piezopump suction port 418 and the pressure compensated actuator volume of hydraulic control fluid 438.

In at least some embodiments, the piezopump cartridge 400 is installed into the piezopump directional control manifold 104 using port isolation seals 418 and by threading the piezopump cartridge 400 into position. The porting arrangement allows any rotational orientation of the piezopump cartridge 400 in the piezopump directional control manifold 104 without affecting operation or performance. The piezoelectric actuator 450 is attached to actuator head 446, which is hollow and ported to allow internal wiring between the piezoelectric actuator 450 and piezopump power lead connector 402, and to maintain pressure equalization. In at least some embodiments, dielectric fluid 442 at ambient pressure fills the hollow space between the connector 402 and the piezoelectric actuator 450. Further, an electrical interconnection 412 extends from the connector 402 to the piezoelectric actuator 450 and eventually forms an electrical daisy chain 434 to each piezoelectric wafer of the piezoelectric actuator 450.

The connector 402 is positioned in place using connector head 444. In the embodiment of FIG. 6, an O-ring 404 may be placed between the actuator head 446 and connector head 444 to provide a seawater/dielectric barrier. In at least some embodiments, the connector head 444 is threaded onto the actuator head 446 at location 406. Further, the actuator head 446 may be threaded onto a perforated tube 448 at location 408. Further, the perforated tube 448 may be threaded onto pump head 456 at location 432. Further, a subplate mount stub 430 near the base of the piezopump cartridge 400 may be threaded (e.g., ACME threaded) into the piezopump directional control manifold 104.

Figure 7:
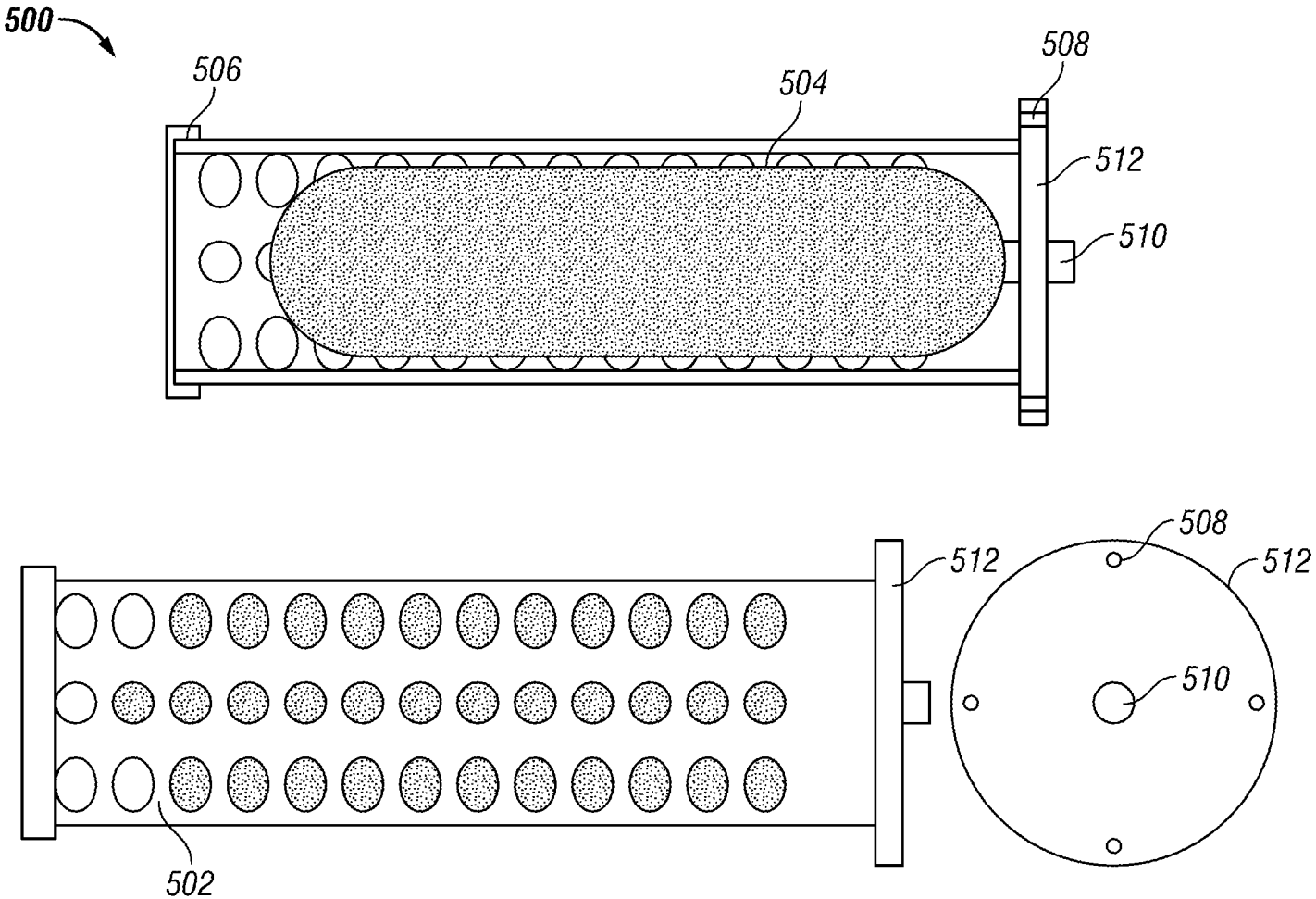
FIG. 7 shows a hydraulic differential reservoir in accordance with an embodiment of the disclosure.

FIG. 7 shows a hydraulic differential reservoir 500 in accordance with an embodiment of the disclosure. The hydraulic differential reservoir 500 is implemented because external hydraulic linear actuators may have different opening and closing volume requirements, necessitating the use of a differential volume to maintain hydraulic closed loop operation. In at least some embodiments, the hydraulic differential reservoir 500 comprises an elastomeric hydraulic bladder 504 to allow the differential volumes to be accommodated during opening and closing activities. Further, a protection cage 502 surrounds the elastomeric hydraulic bladder 504 to prevent external damage. In at least some embodiments, the protection cage 502 is perforated to enable visual inspection of the elastomeric hydraulic bladder 504 (e.g., during surface maintenance and/or testing).

In the embodiment of FIG. 5, a threaded cap 506 is provided at one end of the protection cage 502. At the other end of the protection cage 502, an interface plate 512 is used to enable mounting the hydraulic differential reservoir 500 to a bulkhead and to enable the elastomeric hydraulic bladder 504 to connect to a hose (e.g., hose 124) outside the protective cage 502. As shown, the interface plate 512 includes bulkhead mounting holes 508 and a hose fitting 510 compatible with the elastomeric hydraulic bladder 504 and the external hose. As needed, the entire hydraulic differential reservoir 500 may be removed and replaced by disconnecting the hose fitting 510 from the external hose and dismounting the protection cage 502 at the mounting holes 508. In at least some embodiments, the hydraulic differential reservoir 500 is mounted to a bulkhead in a vertical orientation (with the opening of the elastomeric hydraulic bladder 504 facing upward) to facilitate purging of air from the elastomeric hydraulic bladder 504.

Figure 8:
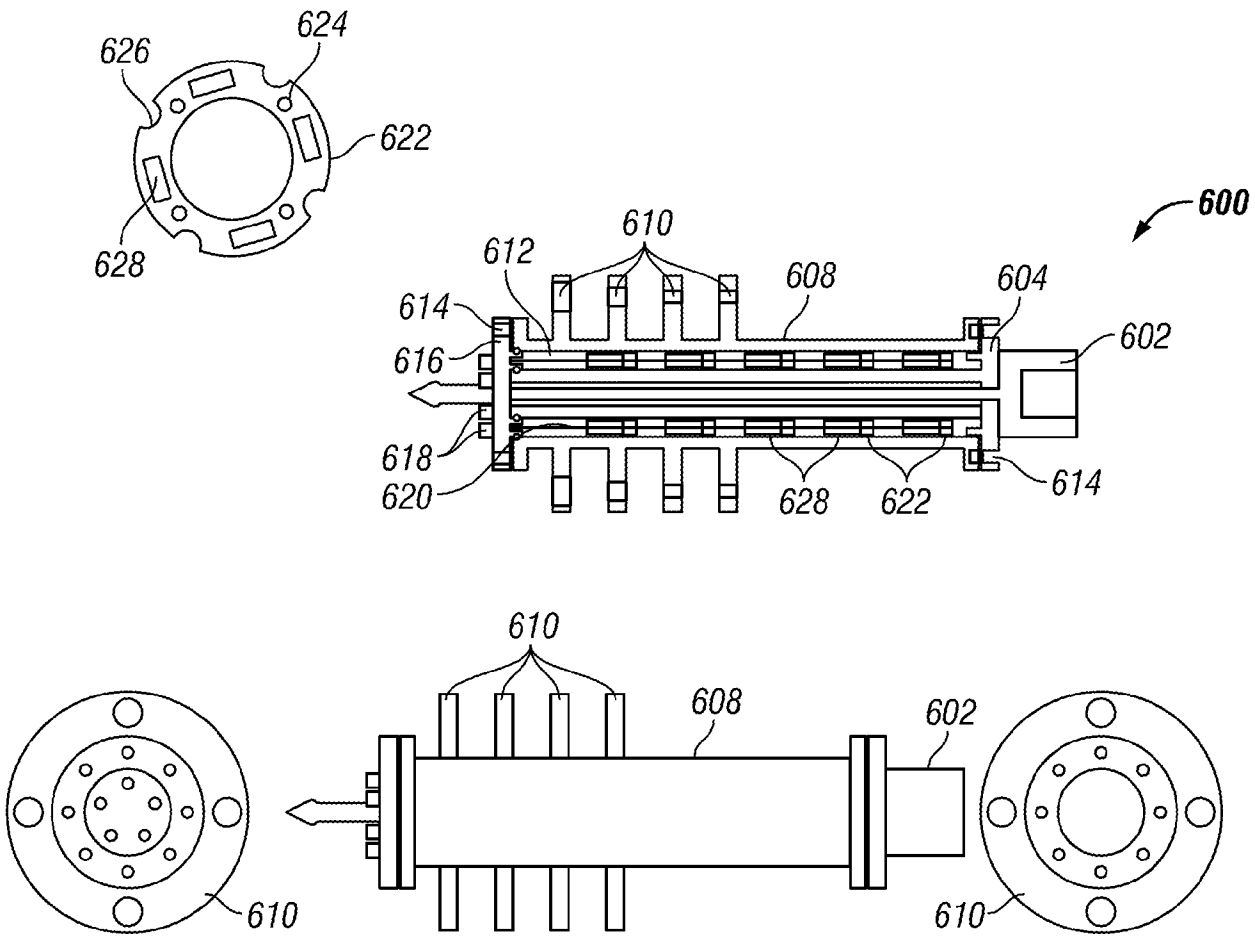
FIG. 8 shows a piezoactuator controller in accordance with an embodiment of the disclosure.

FIG. 8 shows a piezopump actuator controller 600 (e.g., the piezopump actuator controller 102) in accordance with an embodiment of the disclosure. In at least some embodiments, the piezopump actuator controller 600 provides a one atmosphere protected environment 612 for the electrical components necessary to operate the directional control solenoids, piezopumps, and pressure transducers described herein. The piezopump actuator controller 600 also may be structured in a manner that facilitates retrieval by a remotely operated vehicle (ROV).

In at least some embodiments, the piezopump actuator controller 600 comprises electrical modules 628 mounted onto toroidal circuit modules 622 and interconnected by cables 620 to Wet-mate electrical and fiberoptic connectors 618. In the embodiment of FIG. 8, the piezopump actuator controller 600 comprises six toroidal circuit modules 622. In at least some embodiments, each toroidal circuit module 622 has cutaways 626 to facilitate routing of the cables 620 through the annulus of piezopump actuator controller 600. Further, each toroidal circuit module 622 comprises mounting points 624 compatible with guide rods 612, which structurally interconnect the toroidal circuit modules 622. The guide rods 612 are attached to an inboard housing flange 616, allowing the toroidal circuit modules 622 to be removed with the inboard housing flange 616. As shown, the piezopump actuator controller 600 also comprises flange holes 614 for mounting the end flanges 604 and 616 to outer body 608.

In at least some embodiments, a ROV bucket, drive, and latch 602 runs through the center of the toroidal circuit modules 622 to allow the modules 622 to be connected to field receptacles for the piezopump power cable 118, the directional control cable 116, the open/close pressure transducer cable 114, the external communications and instrument power cable 120, and the external DC power supply cable 122. The initial and intermediate guidance of the piezopump actuator controller 600 into a field receptacle is afforded by the use of concentric alignment guides 610.

Figure 9:
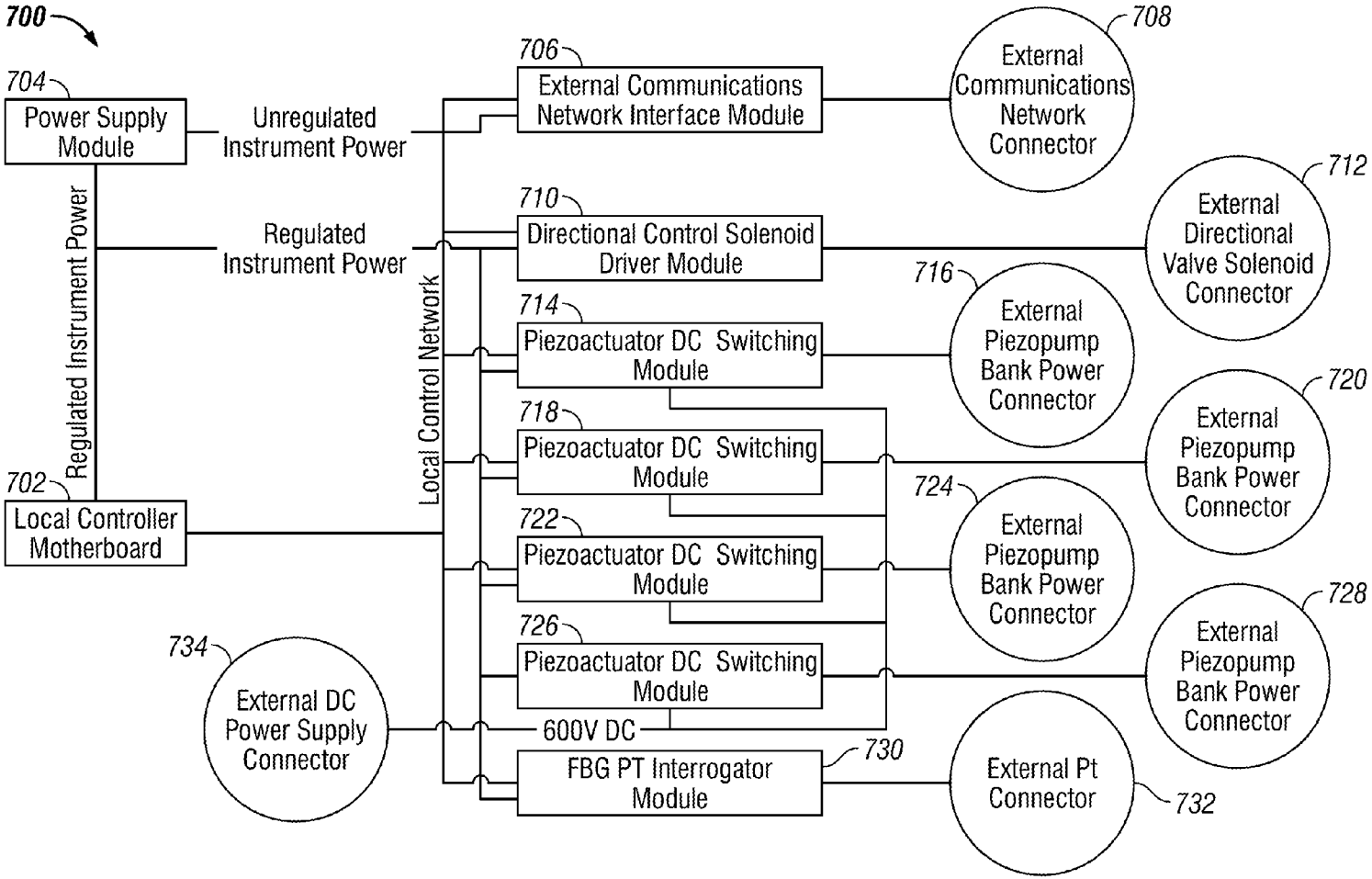
FIG. 9 shows electrical modules within the piezoactuator control assembly of FIG. 8 in accordance with an embodiment of the disclosure.

FIG. 9 shows electrical modules within the piezopump actuator controller 600 of FIG. 8 in accordance with an embodiment of the disclosure. The modules of piezopump actuator controller 600 comprise a power supply module 704 that provides unregulated instrument power or regulated instruments power to the other modules. For example, the power supply module 704 may provide unregulated instrument power to an external communication network interface module 706 and provide regulated instrument power to a local controller motherboard 702. Further, the power supply module 704 also may provide regulated instrument power to a directional control solenoid driver module 710, a plurality of piezoactuator DC switching modules 714, 718, 722, 726, and a Fiberoptic Bragg Grating pressure transducer (FBG PT) interrogator module 730.

As shown in FIG. 9, the modules of the piezopump actuator controller 600 are networked for communications. For example, the external communication network interface module 706 may be networked for communications to the directional control solenoid driver module 710, the plurality of piezoactuator DC switching modules 714, 718, 722, 726, and the FBG PT interrogator module 730. In some embodiments, external communications/instructions may be received by the external communication network interface module 706 and selectively forwarded to the directional control solenoid driver module 710, the plurality of piezoactuator DC switching modules 714, 718, 722, 726, and the FBG PT interrogator module 730. Further, the directional control solenoid driver module 710, the plurality of piezoactuator DC switching modules 714, 718, 722, 726, and the FBG PT interrogator module 730 may selectively send information to the external communication network interface module 706, which is able to forward the information to an external control center (e.g., a surface vessel facility). Although not necessarily required, communications between the directional control solenoid driver module 710, the plurality of piezoactuator DC switching modules 714, 718, 722, 726, and the FBG PT may be channeled through the external communication network interface module 706, which acts as a communications hub for the piezopump actuator controller 600.

The local controller motherboard 702 provides supervisory control functionality over the directional control solenoid driver module 710, the piezoactuator DC switching modules 714, 718, 722, 726, and the FBG PT interrogator module 730. In operation, the piezopump actuator controller 600 is able to open/close external hydraulic linear actuators, maintain open/close pressure, and provide applied force control using a closed loop algorithm based on feedback from open/close pressure transducer measurements. Further, the piezoactuator DC switching modules 714, 718, 722, 726 operate multiple piezopump cartridges allowing flow rates to be controlled. In this manner, control of variable opening and closing speeds is achieved without the use of servo flow control valves.

Each of the modules of the piezopump actuator controller 600 shown in FIG. 9 is related to a corresponding connector. As shown in FIG. 9, the external communications network interface module 706 is related to external communications network connector 708. Meanwhile, the directional control solenoid driver module 710 is related to external directional valve solenoid connector 712. The piezoactuator DC switching modules 714, 718, 722, 726 are related to respective external piezopump bank power connectors 716, 720, 724, 728. The piezoactuator DC switching modules 714, 718, 722, 726 are also related to an external DC power supply connector 734. Finally, the FGB PT interrogator module 730 is related to external pressure transducer connector 732. In at least some embodiments, the modules 702, 704, 706, 710, 714, 718, 722, 726, and 730 of FIG. 9 are distributed on the toroidal circuit modules 622 of FIG. 8.

Figure 10:
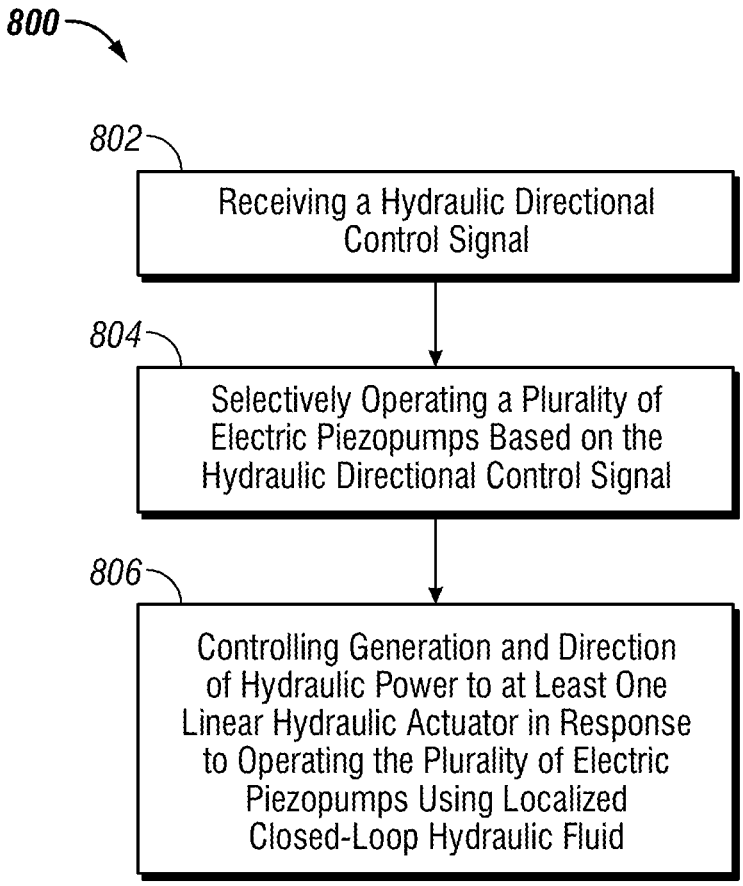
FIG. 10 shows a method in accordance with an embodiment of the disclosure.

FIG. 10 shows a method 800 in accordance with an embodiment of the disclosure. Though depicted sequentially as a matter of convenience, at least some of the actions shown can be performed in a different order and/or performed in parallel. Additionally, some embodiments may perform only some of the actions shown. The operations of FIG. 10, as well as other operations described herein, enable the disclosed bidirectional cartridge piezopumps (e.g., in a piezopump directional control manifold such as manifold 104) to actuate components such as a hydraulic Ram blowout preventer (BOP), a hydraulic BOP annular, a hydraulic wellhead connector, a hydraulic LMRP, a hydraulic failsafe gate valve, a hydraulic LMRP collet connector, a hydraulic annular bleed valve and/or a hydraulic Ram BOP lock.

As shown, the method 800 comprises receiving a hydraulic directional control signal (block 802). The hydraulic directional control signal may be received, for example, from a remote surface vessel facility. At block 804, a plurality of electric piezopumps are selectively operated based on the hydraulic directional control signal. In at least some embodiments, selectively operating a plurality of electric piezopumps comprises operating, for each electric piezopump, a pressure balanced piezoelectric actuator piston integrated with a pump cylinder body containing low-mass reed-type check valves. Finally, the method 800 comprises controlling generation and direction of hydraulic power to at least one linear hydraulic actuator in response to operating the plurality of electric piezopumps using localized closed-loop hydraulic fluid (block 806). In at least some embodiments, each linear hydraulic actuator is operated over a remotely configurable performance range. As an example, each linear hydraulic actuator may be remotely configured for a performance range (bore/stroke and/or speed) corresponding to one of a hydraulic Ram blowout preventer (BOP), a hydraulic BOP annular, a hydraulic wellhead connector, a hydraulic LMRP, a hydraulic failsafe gate valve, a hydraulic LMRP collet connector, a hydraulic annular bleed valve and/or a hydraulic Ram BOP lock.

While preferred embodiments of this invention have been shown and described, modifications thereof can be made by one skilled in the art without departing from the scope or teaching of this invention. The embodiments described herein are exemplary only and are not limiting. Many variations and modifications of the system and apparatus are possible and are within the scope of the invention. For example, the relative dimensions of various parts, the materials from which the various parts are made, and other parameters can be varied, so long as the override apparatus retain the advantages discussed herein. Accordingly, the scope of protection is not limited to the embodiments described herein, but is only limited by the claims that follow, the scope of which shall include all equivalents of the subject matter of the claims.

What is claimed is:

1. An apparatus, comprising:

a hydraulic directional control manifold;

a plurality of electric piezopumps; and an electric piezopump controller that operates the plurality of electric piezopumps in varying combinations to provide generation and directional control of hydraulic power to linear hydraulic actuators.

2. The apparatus as set forth in claim 1 wherein the hydraulic directional control manifold comprises a manifold block with a plurality of electric piezopump mounting pockets and subplate mounted electric solenoid valves for switching electric piezopump suction and discharge porting between linear actuator operating ports and reservoir ports.

3. The apparatus of claim 2 wherein the hydraulic directional control manifold controls the direction of hydraulic power applied to the linear hydraulic actuators.

4. The apparatus of claim 1 wherein each electric piezopump comprises a pressure balanced piezoelectric actuator piston integrated with a pump cylinder body containing low-mass reed-type check valves ported to suction and discharge outlets matched to a hydraulic directional control manifold pocket porting.

5. The apparatus of claim 4 wherein each electric piezopump is configured to convert electric power into hydraulic power applied to at least one of the linear hydraulic actuators.

6. The apparatus of claim 1 wherein the electric piezopump controller comprises a plurality of piezoactuator DC switching modules that communicate with a communications network interface to operate the plurality of electric piezopumps and the hydraulic directional control manifold.

7. The apparatus of claim 1 wherein the electric piezopump controller operates each linear hydraulic actuator over a remotely configurable performance range.

8. The apparatus of claim 1 wherein the hydraulic directional control manifold is mounted to at least one of said linear hydraulic actuators in a swivel arrangement.

9. The apparatus of claim 1 wherein the swivel arrangement is based on a knuckle joint that extends through the hydraulic directional control manifold and into a linear hydraulic actuator.

10. An apparatus, comprising:

a hydraulic directional control manifold;

a plurality of electric piezopumps; and an electric piezopump controller that operates the plurality of electric piezopumps in varying combinations to provide generation and directional control of hydraulic power to linear hydraulic actuators;

wherein the electric piezopump controller is configured to receive communications and power from a surface vessel facility.

11. A method, comprising:

receiving a hydraulic directional control signal;

selectively operating a plurality of electric piezopumps based on the hydraulic directional control signal; and operating the plurality of electric piezopumps to control generation and direction of hydraulic power to linear hydraulic actuators.

12. The method of claim 11 wherein selectively operating a plurality of electric piezopumps comprises operating, for each electric piezopump, a pressure balanced piezoelectric actuator piston integrated with a pump cylinder body containing low-mass reed-type check valves.

13. The method of claim 11 further comprising operating each linear hydraulic actuator over a remotely configurable performance range.

14. A method, comprising:

receiving a hydraulic directional control signal;

selectively operating a plurality of electric piezopumps based on the hydraulic directional control signal; and controlling generation and direction of hydraulic power to at least one linear hydraulic actuator in response to operating the plurality of electric piezopumps;

wherein receiving the hydraulic directional control signal comprises receiving the hydraulic directional control signal from a remote surface vessel facility.

15. A piezoelectric pump assembly for use a subsea environment, the piezoelectric pump assembly comprising:

a piezoelectric actuator;

a piston reciprocated by the piezoelectric actuator;

a pump chamber;

a first barrier that separates sea water from hydraulic fluid; and a second barrier that separates hydraulic fluid from dielectric fluid;

wherein hydraulic fluid is drawn into the pump chamber through a suction reed valve and is expelled from the pump chamber through a discharge reed valve by the piston.

16. The piezoelectric pump assembly of claim 15 further comprising retainer plugs for the suction reed valve and the discharge reed valve.

17. The piezoelectric pump assembly of claim 15 wherein the first barrier further comprises an elastomer tube barrier the second barrier further comprises an elastomer tube barrier.

18. The piezoelectric pump assembly of claim 15 further comprising a perforated tube threaded to an actuator head and a pump head, wherein the piezoelectric actuator operates within the perforated tube.

19. The piezoelectric pump assembly of claim 15 further comprising a perforated tube threaded to an actuator head and a pump head, wherein the piezoelectric actuator operates within the perforated tube.

* * * * *